US008459829B2

(12) United States Patent
Cao et al.

(10) Patent No.: US 8,459,829 B2
(45) Date of Patent: Jun. 11, 2013

(54) ILLUMINATING SYSTEM,UNIVERSAL LAMP HOLDER AND LED LAMP

(75) Inventors: Qing-Shan Cao, Shenzhen (CN); Sheng-Peng Tseng, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 385 days.

(21) Appl. No.: 12/765,871

(22) Filed: Apr. 23, 2010

(65) Prior Publication Data

US 2011/0188238 A1 Aug. 4, 2011

(30) Foreign Application Priority Data

Feb. 2, 2010 (CN) ..... 2010 1 0301100

(51) Int. Cl.
*F21V 21/00* (2006.01)

(52) U.S. Cl.
USPC ..... 362/217.14; 362/249.02; 362/217.01; 362/221

(58) Field of Classification Search
USPC ..... 362/217.01, 221, 249.02, 249.05, 362/249.1, 249.12
See application file for complete search history.

(56) References Cited

U.S. PATENT DOCUMENTS 7,331,689 B2 * 2/2008 Chen ..... 362/240
7,490,957 B2 * 2/2009 Leong et al. ..... 362/249.05
8,193,713 B2 * 6/2012 Jung et al. ..... 315/158

FOREIGN PATENT DOCUMENTS

CN 101956905 A 1/2011

* cited by examiner

*Primary Examiner* — Anabel Ton
(74) *Attorney, Agent, or Firm* — Altis Law Group, Inc.

(57) ABSTRACT

An illuminating system includes a universal lamp holder. The universal lamp holder includes a switch unit, a starter, a ballast, a first socket and a second socket. The ballast is connected to the voltage-input terminal and the first socket. The starter is connected to the first socket and the switch unit. The second socket is connected to the switch unit and the voltage-output terminal, and the switch unit is configured for selectively connecting the second socket to the voltage-input terminal or connecting the second socket to the starter. When the second socket is switched to connect to the voltage-input terminal, the illuminating system is switched to an LED lamp mode, and when the second socket is switched to be connected to the starter, the illuminating system is switched to a fluorescent lamp mode.

9 Claims, 2 Drawing Sheets

ILLUMINATING SYSTEM,UNIVERSAL LAMP HOLDER AND LED LAMP

BACKGROUND

1. Technical Field

The present disclosure relates to illuminating systems and, particularly, to an illuminating system using a universal lamp holder and an light-emitting diode (LED) lamp.

2. Description of the Related Art

LEDs are widely used due to their advantageous characteristics. However, conventional lamp holders, for example fluorescent lamp holders, cannot be used to hold LED lamps, and also, LED lamp holders cannot be used to hold fluorescent lamps. Therefore, if users want to replace a fluorescent lamp with an LED lamp or replace an LED lamp with a fluorescent, they have to replace the holders as well.

BRIEF DESCRIPTION OF THE DRAWINGS

The components in the drawings are not necessarily drawn to scale, the emphasis instead being placed upon clearly illustrating the principles of an illuminating system, a universal lamp holder, and an LED lamp. Moreover, in the drawings, like reference numerals designate corresponding parts throughout the several views.

DETAILED DESCRIPTION

Figure 1:
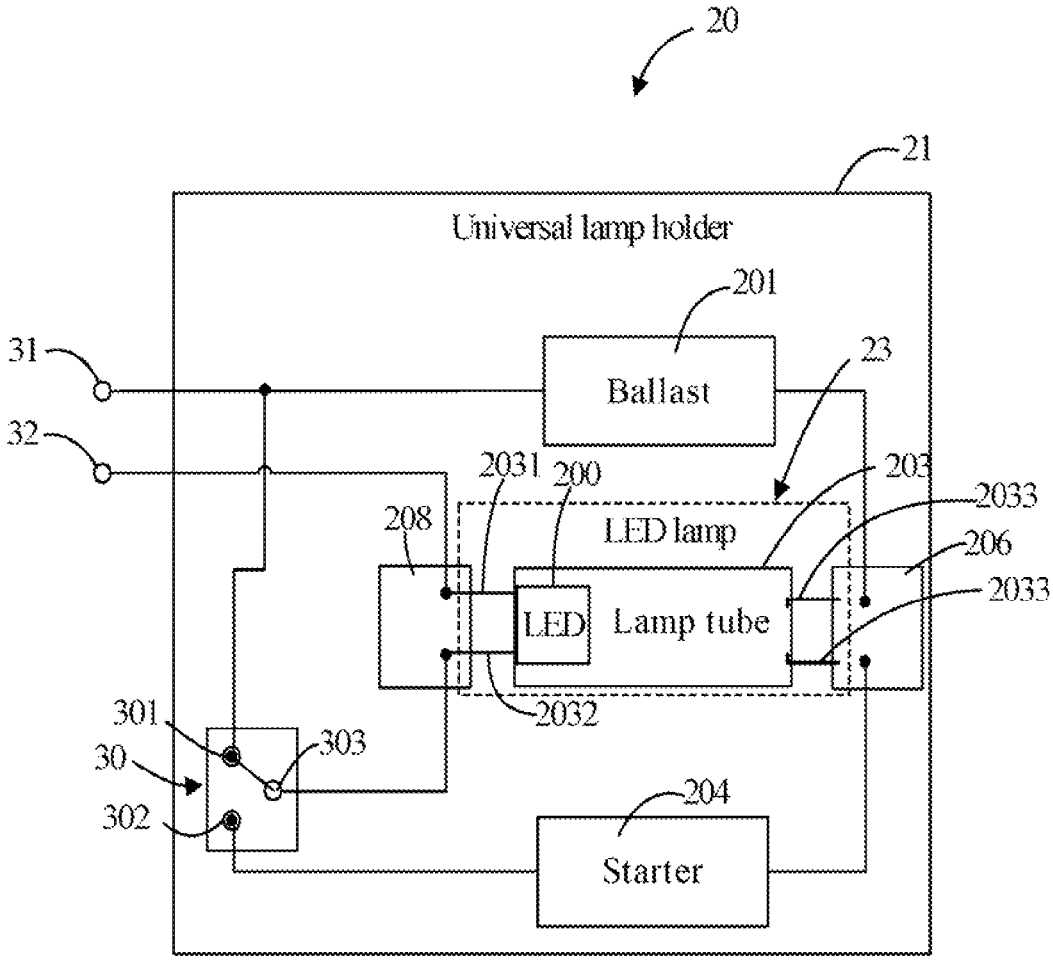
FIG. 1 is a circuit diagram of an illuminating system in accordance with an exemplary embodiment, showing an LED lamp mounted in a universal lamp holder of the illuminating system.

Referring to FIG. 1, an illuminating system 20 includes a universal lamp holder 21. The universal lamp holder 21 can be employed to hold an LED lamp 23 or a fluorescent lamp 24 (see FIG. 2). The lamp holder 21 includes a switch unit 30 configured for selectively switching between operational modes of the illuminating system 20, for example, between an LED lamp mode and a fluorescent lamp mode. In the LED mode, the LED lamp 23 mounted in the universal lamp holder 21 can be lighted. In the fluorescent lamp mode, the fluorescent lamp 24 mounted in the universal lamp holder 21 can be lighted.

The LED lamp 23 includes a lamp tube 203, a pair of conductive lamp bases 2031 and 2032, and at least one fixing lamp base 2033. At least one LED 200 is encapsulated within the lamp tube 203. The conductive lamp bases 2031 and 2032 extending from one end of the lamp tube 23 are connected to two pins (not shown) of the at least one LED 200, respectively. In an alternative embodiment, an AC/DC convertor (not shown) is employed to connect the conductive lamp bases 2031 and 2032 to the pins of the LED 200. The at least one fixing lamp base 2033 extending from the other end of the lamp tube 23 is not electrically connected to the pins of the LED 200. The at least one fixing lamp base 2033 cooperates with the conductive lamp bases 2031 and 2032 to fix the LED lamp 23 to the universal lamp holder 21. In the embodiment, the at least one fixing lamp base 2033 includes a pair of fixing lamp bases 2033. The fixing lamp bases 2033 are made of insulating material.

The universal lamp holder 21 further includes a ballast 201, a starter 204, a first socket 206, and a second socket 208. The first socket 206 includes two first jacks (not labeled) and the second socket 208 includes two second jacks (not labeled). The ballast 201 is connected to a voltage-input terminal 31 and one of the first jacks of the first socket 206. The starter 204 is connected to the other first jack of the first socket 206 and the switch unit 30. One of the second jacks of the second socket 208 is connected to the switch unit 30 and the other second jack is connected to a voltage-output terminal 32. The switch unit 30 is further connected to the voltage-input terminal 31.

Figure 2:
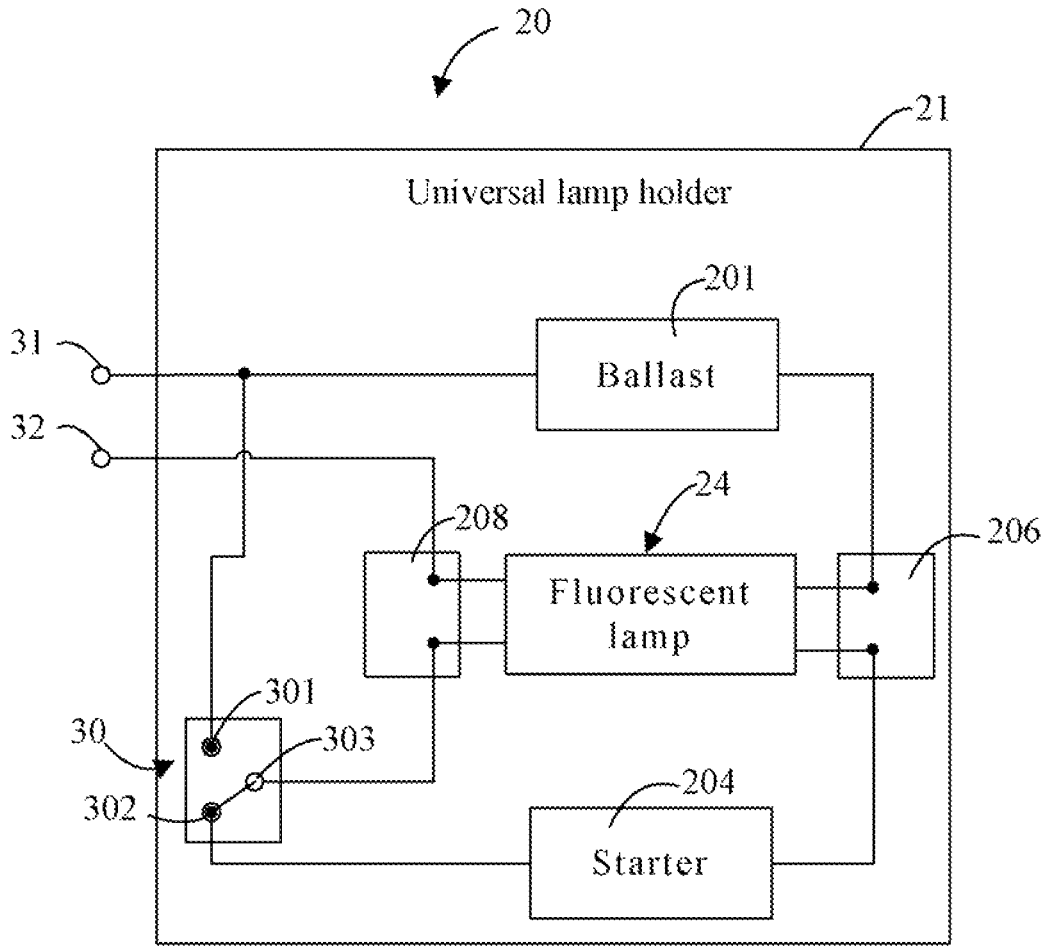
FIG. 2 is a circuit diagram of the illuminating system of FIG. 1, showing a fluorescent lamp mounted in the universal lamp holder.

In the embodiment, the switch unit 30 is configuring for selectively connecting the second socket 208 to the starter 204 or connecting the second socket 208 to the voltage-input terminal 31. In the embodiment, as shown in FIG. 1, when the second socket 208 is switched to be connected to the voltage-input terminal 31, the system 20 is switched to the LED mode. That is, when the LED lamp 23 is mounted on the universal lamp holder 21, the fixing lamp bases 2033 are inserted into the first socket 206 to fix the LED lamp 23, the conductive lamp bases 2031 and 2032 are inserted into the second socket 208, and the voltage-input terminal 31, the LED lamp 23, and the voltage-output terminal 32 form a loop, thus the LED lamp 23 can be lighted. As shown in FIG. 2, when the second socket 208 is switched to be connected to the starter 204, the system 20 is switched to the fluorescent lamp mode. That is, when the fluorescent lamp 24 is mounted in the universal lamp holder 21, conductive lamp bases (not labeled) of the fluorescent lamp 24 are inserted into the first socket 206 and the second socket 208, respectively, and the voltage-input terminal 31, the ballast 201, the fluorescent lamp 24, the starter 204, and the voltage-output terminal 32 form a loop, thus the fluorescent lamp 24 can be lighted.

In the embodiment, the switch unit 30 is a single-pole double throw switch. The switch unit 20 includes a moveable terminal 303, a first terminal 301 and a second terminal 302. The first terminal 301 is connected to the voltage-input terminal 31. The second terminal 302 is connected to the starter 204. The moveable terminal 303 is connected to one of the second jacks of the second socket 208. When the moveable terminal 303 is switched to be connected to the first terminal 301, the system 20 is switched to the LED lamp mode. When the moveable terminal 303 is switched to be connected to the second terminal 302, the system 20 is switched to the fluorescent lamp mode. In an alternative embodiment, the switch unit 30 can be a double-pole double throw switch or a light-coupled semi-conductor switch.

It is understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An illuminating system comprising:

a universal lamp holder comprising:

a ballast;

a starter;

a first socket;

a second socket; and a switch unit;

wherein the ballast is connected to a voltage-input terminal and the first socket, the starter is connected to the first socket and the switch unit, the second socket is connected to the switch unit and a voltage-output terminal, and the switch unit is configured for selectively connecting the second socket to the voltage-input terminal or connecting the second socket to the starter, wherein the second socket is switched to be connected to the voltage-input terminal to put electric power to an LED lamp mounted on the universal lamp holder, and the second socket is switched to be connected to the starter to put electric power to a fluorescent lamp mounted on the universal lamp holder.

2. The illuminating system as claimed in claim 1, wherein the LED lamp comprises at least one LED, a lamp tube and a pair of conductive lamp bases extending from one end of the lamp tube, the at least one LED is encapsulated within the lamp tube, the conductive lamp bases are electrically connected to the at least one LED and can be inserted into the second socket.

3. The illuminating system as claimed in claim 2, wherein the LED lamp further comprising at least one fixing lamp base extending from the other end of the lamp tube; the at least one fixing lamp base is not electrically connected to the at least one LED and can be inserted into the first socket.

4. The illuminating system as claimed in claim 3, wherein the at least one fixing lamp base is made of insulating material.

5. The illuminating system as claimed in claim 1, wherein the switch unit is a single-pole double throw switch, the switch unit comprises a moveable terminal, a first terminal and a second terminal; the first terminal is connected to the voltage-input terminal, the second terminal is connected to the starter, and the moveable terminal is connected to the second socket.

6. The illuminating system as claimed in claim 1, wherein the switch unit is a double-pole double throw switch or a light-coupled semi-conductor switch.

7. A universal lamp holder comprising:

a first socket;

a second socket connected to a voltage-output terminal;

a ballast connected to a voltage-input terminal and the first socket;

a starter connected to the first socket; and a switch unit configured for selectively connecting the second socket to the voltage-input terminal or connecting the second socket to the starter, wherein the second socket is switched to be connected to the voltage-input terminal to put electric power to an LED lamp mounted on the universal lamp holder, and the second socket is switched to be connected to the starter to put electric power to a fluorescent lamp mounted on the universal lamp holder.

8. The universal lamp holder as claimed in claim 7, wherein the switch unit is a single-pole double throw switch, the switch unit comprises a moveable terminal, a first terminal and a second terminal; the first terminal is connected to the voltage-input terminal, the second terminal is connected to the starter, and the moveable terminal is connected to the second socket.

9. The universal lamp holder as claimed in claim 7, wherein the switch unit is a double-pole double throw switch or a light-coupled semi-conductor switch.

* * * * *